US005878787A

United States Patent [19]

Speich

[11] Patent Number: 5,878,787

[45] Date of Patent: Mar. 9, 1999

[54] RIBBON LOOM WITH SEPARATE GUIDE EYE

[75] Inventor: Francisco Speich, Gipf-Oberfrick, Canada

[73] Assignee: Textilma AG, Hergiswil, Switzerland

[21] Appl. No.: 860,264

[22] PCT Filed: Dec. 19, 1995

[86] PCT No.: PCT/CH95/00301

§ 371 Date: Jun. 19, 1997

§ 102(e) Date: Jun. 19, 1997

[87] PCT Pub. No.: WO96/19604

PCT Pub. Date: Jun. 27, 1996

[30] Foreign Application Priority Data

Dec. 22, 1994 [DE] Germany ..... 94 20 562

[51] Int. Cl.[6] ..... D03D 35/00; D03D 47/34

[52] U.S. Cl. ..... 139/22; 139/450; 139/194

[58] Field of Search ..... 139/22, 23, 450, 139/194, 452

[56] References Cited

U.S. PATENT DOCUMENTS

| | | | |
|---|---|---|---|
| 2,469,202 | 5/1949 | Murdock et al. | 139/452 |
| 3,502,253 | 3/1970 | van Mullekom . | |
| 3,665,976 | 5/1972 | Freihofer | 139/452 |
| 3,669,328 | 6/1972 | Castelli | 139/452 X |
| 4,090,536 | 5/1978 | Van Mullekom | 139/452 |
| 4,298,033 | 11/1981 | Takahashi et al. | 139/450 |
| 4,479,518 | 10/1984 | Kiwior | 139/452 |
| 4,646,792 | 3/1987 | Villa et al. | 139/452 |

FOREIGN PATENT DOCUMENTS

| | | |
|---|---|---|
| 7731728 | 5/1978 | France . |
| 2722022 | 4/1980 | Germany . |
| 2936197 | 5/1980 | Germany . |
| 9420562 | 3/1995 | Germany . |
| 650291 | 7/1985 | Switzerland . |
| 2039547 | 8/1980 | United Kingdom . |

*Primary Examiner*—Andy Falik

*Attorney, Agent, or Firm*—Hovey, Williams, Timmons & Collins

[57] ABSTRACT

A ribbon loom for making a material web at high speed operates through precise control of the weft thread. The ribbon loom comprises a weft insertion needle to insert a loop of weft thread into a shed. The weft thread loop is tied off by a knitting needle on the side of the web away from the insertion needle. The insertion needle is served by a feed device for the weft thread containing a pneumatically operated compensator in the form of a blower and/or a suction device. The insertion needle also has a separate guide eye for the weft thread. This thus provides a particularly effective compensator ensuring precise control of the weft thread when the ribbon loom is running at high speed. The web edges are always tensioned to the set width and maintained at a constant width.

15 Claims, 5 Drawing Sheets

Fig. 4a
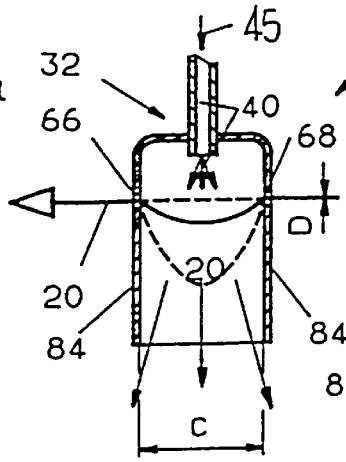
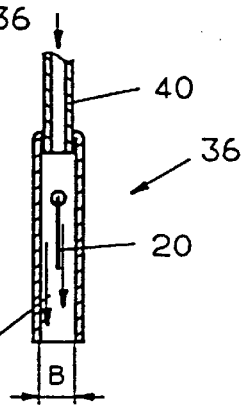
Fig. 4b
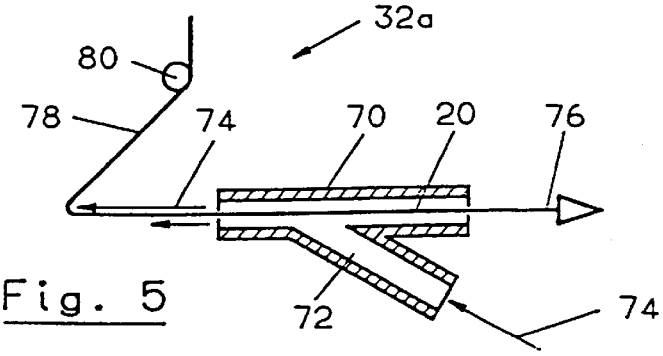
Fig. 5
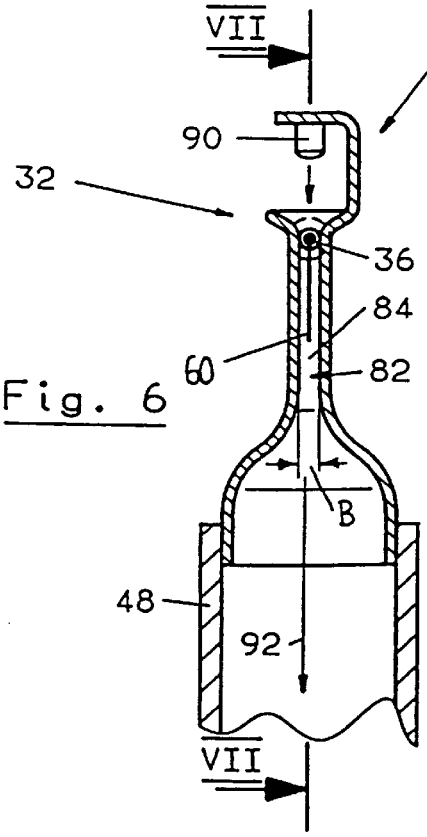
Fig. 6
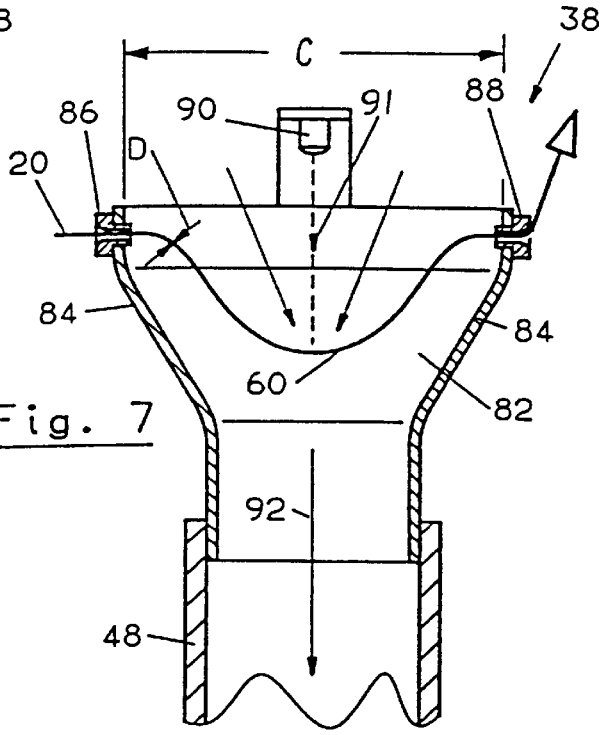
Fig. 7

RIBBON LOOM WITH SEPARATE GUIDE EYE

BACKGROUND OF THE INVENTION

1. Field of Technology

This invention relates to a ribbon loom having a weft compensating device.

2. Description of the Prior Art

Ribbon looms of the type stated in the introduction are known in diverse forms, for example from GB-B-2 039 547. The ribbon loom contains, a weft insertion needle, to which is assigned a weft supply device, which has—as viewed in the running direction of the weft—a weft source, a weft braking-device, a weft conveying device, and a weft compensating device. The weft compensating device is formed by a leg spring, which moves back and forth between a first and a second position. In the first position, the leg spring releases the weft for insertion of a weft loop, by means of a weft insertion needle, into a shed. Upon withdrawal of the weft insertion needle from the shed, the leg spring takes up the second position, in which it accepts a weft reserve and finally clamps the weft in a cleft formed with a leaf spring, in order to prevent further conveyance. Upon reinsertion of the weft into the shed, the weft is again tensioned, and the leg spring moves out of the second position into the first position, the weft simultaneously coming free from the clamping leaf spring. This compensating device has the disadvantage that it is relatively sluggish, so that a ribbon loom therewith equipped is limited in its drive speed of rotation, specifically the introduction and extraction of the weft on the braking leaf spring further limiting the efficiency of the ribbon loom.

Ribbon looms with such mechanical compensating devices have the disadvantage that they are limited in their performance, that is, in the maximum speed of rotation up to 2500 revolutions per minute (rpm). If such a ribbon loom is operated at a higher speed of rotation, serious problems arise. The leg springs can break and/or they enter into a critical vibration range, in which the tension of the weft can no longer be controlled. Natural vibrations and inertial forces require a greater spring force, which can become greater than the tear strength of the weft to be processed. As a consequence of the required greater leg spring force, the service life of the latch type weaving needles decreases to ½ hour. Moreover, as a consequence of the excessively high weft tension strong interlacing of the ribbons to be produced is caused, and the ribbon cannot be kept at a constant width, the ribbon being narrower, in particular on starting of the ribbon loom. Further, edge wire breaks occur as a consequence of the required excessively high weft tension.

In customary ribbon looms, today all the mesh edge types are produced with latch type weaving needles, also called latch needles. Such latch type weaving needles are suitable only up to speeds of rotation of 2500 rpm. At higher speeds of rotation, breaks occur by the hooks and latches, the latter as a result of the high acceleration upon deflection of the latches. The service lives of the latch type weaving needles at speeds of rotation of 2500 to 4000 rpm are approximately 1 to 4 hours, which is not acceptable in practice.

Known from each of F.R.-A-2 368 561 and U.S. Pat. No. 3,502,253 are pneumatic compensating devices for wefts for shuttle less looms, in which, from a weft reserve, in each case via a delivery mechanism, a weft is continuously withdrawn and supplied to a pneumatic compensating device. In the latter, the continuously supplied weft is formed into a reserve loop, from which the weft length required for weft insertion is periodically withdrawn for each weft insertion. For this purpose, the weft coming from the compensating device is led via a controlled clamping device to a blowing nozzle which, at the proper moment, blows a section of weft into an open shed.

The length of the blown-in section of weft is determined by the opening time of the clamping device. The weft insertion is interrupted by closing of the clamping device, and the inserted weft section (single pick) is separated from the supplied weft by means of a cutting device. The clamping device serves both for controlling the section of weft to be inserted and for preventing weft retraction from the blowing nozzle between two insertion operations. Obviously, such a weft supply is completely unsuitable for a ribbon loom having a weft insertion needle. In such a needle ribbon loom, the weft is at no time cut into sections, but is uninterruptedly connected to the fabric to be manufactured and is inserted into the shed in the form of a weft loop (double pick) and bound off at one material edge by means of a weaving needle. The clamping device would prevent not only the practically uninterrupted weft transport to the fabric, but also and in particular the retraction of the weft necessary for tensioning of the weft and for the formation of a proper woven edge.

SUMMARY OF THE INVENTION

It is the object of the invention to make a ribbon loom of the type stated in the introduction in such a way that it permits greater performance.

This object is achieved according to the invention as described and claimed herein.

As a result of the fact that the compensating device is designed pneumatically operating as a blowing and/or suction device, there results a ribbon loom, whose weft compensating device is practically mass-free or is limited to the mass of the weft to be handled. The tension of the weft can thus be kept absolutely constant and at the lowest value, this tension, as a result of preferably adjustable components of the supply device, being subtly adaptable to the conditions determined by the weft material and/or the weaving conditions. As a result, the retraction tension required for a trouble-free ribbon loom can be precisely maintained for the inserted weft loop, and the magnitude of the tension can be regulated by means of a preferably adjustable guide eye. This opens up new dimensions for the efficiency of a ribbon loom, which, in contrast to known ribbon looms, can now be operated at a much higher speed of rotation, for example, 3000 to 6000 rpm.

Advantageous enhancements of the ribbon loom are described below.

Particularly advantageous is an enhancement where, by means of the guide eye, the extension of the weft can be positionaly adjusted with the weft insertion needle withdrawn and inserted.

With reference to the compensating device, various possible embodiments results; particularly advantageous is one where the blowing device and/or the suction device has a shallow rectangular chamber which comprises on one narrow side a weft supply and on the other narrow side a weft discharge, since the chamber assures an exact guideness of the weft so that the effect of the air stream on the weft can also be exactly determined and controlled. An advantageous design of the chamber is described where the width of the chamber is equal to or smaller than 50 times the thickness of the weft and that length is greater than the width. The enhanced embodiment where the weft in the chamber can be monitored for breakage or run-out by means of a weft protector, preferably in the direction of flow of the air stream improves the monitoring of the weft in the chamber.

A further possibility for enhancement of the compensating device, is provided where it has a channel section for the weft, into which a blowing nozzle opens at an acute angle in such way that the blown air stream opposes the running direction of the weft.

The enhancements of the ribbon loom where a weft breaking device is arranged upstream from the compensating device and where upstream or downstream from the compensation device, a preferably optically operable weft protector is positioned, and where the supply device has a weft source and a weft conveying device which are positioned upstream from the compensating device contribute to subtler control of the weft and thus to adaptation to the thread quality, on the one hand, and the weaving conditions, on the other. The supply device for the weft is advantageously adjustable in such a way where the supply device is adjustable so that the weft is extended, both with a withdrawn and with an inserted weft insertion needle. As a results, not only is the weft reserve necessary upon insertion of the weft maintained particularly small, but also potential vibrations of the weft during the insertion cycle are prevented, which represent a load on the weft and would impair the weaving process. The extension of the weft, with an inserted and a withdrawn weft insertion needle is preferably adjusted by means of the weft conveying device. The adjustment of the extension of the weft, with an inserted and a withdrawn weft insertion needle, is preferably achieved by means of the guide eye; in this process, the selvages are always tensioned to the set ribbon width and held to an exactly constant width.

To bind off the weft loop, after its insertion into the shed, up to the ribbon loom speeds of revolution customary today (up to 3000 rpm), the most varied weaving needles can be used, thus for example the customary latch needles and crochet needles. In the case of high-speed looms, the slide weaving needle, called slide needle for short, represents practically the only design element that not only permits trouble-free operation but also offers the required service life. Because the slide needle has no latch, the problems associated therewith are entirely eliminated. By the arrangement with a joint pivot axis for the hook and slide part, exact running of both parts is made possible. As a result, wear and tear is practically completely eliminated. Moreover, the two parts can be very exactly adjusted to one another, and the value, once adjusted, remains maintained constant during the operation of the ribbon loom. Safe capturing of the weft and any potential auxiliary thread is reliably assured at the maximum speed of rotation because the slide needle is forced to open and close. It is particularly advantageous if the slide needle is designed wherein the hook of the hook part of the slide needle on the side of the material web facing away from the weft insertion needle is inclined at an angle of 0° to 180° to the plain of motion of the slide needle.

BRIEF DESCRIPTION OF THE DRAWING

Exemplary embodiments of the ribbon loom according to the invention are described in detail hereinafter, based on schematic drawings, showing.

FIG. 4*a*, a first weft compensating device in schematic representation in a vertical section taken from the front.

FIG. 4*b*, the first weft compensating device of FIG. 4*a* in schematic representation in a vertical section taken from either the left or the right side.

FIG. 5, a second weft compensating device in schematic representation.

FIG. 6, a third weft compensating device in a section transverse to the running direction of the weft.

FIG. 7, the weft compensating device of FIG. 6 in Section VII—VII of FIG. 6.

DESCRIPTION OF THE PREFERRED EMBODIMENT

Figure 1:
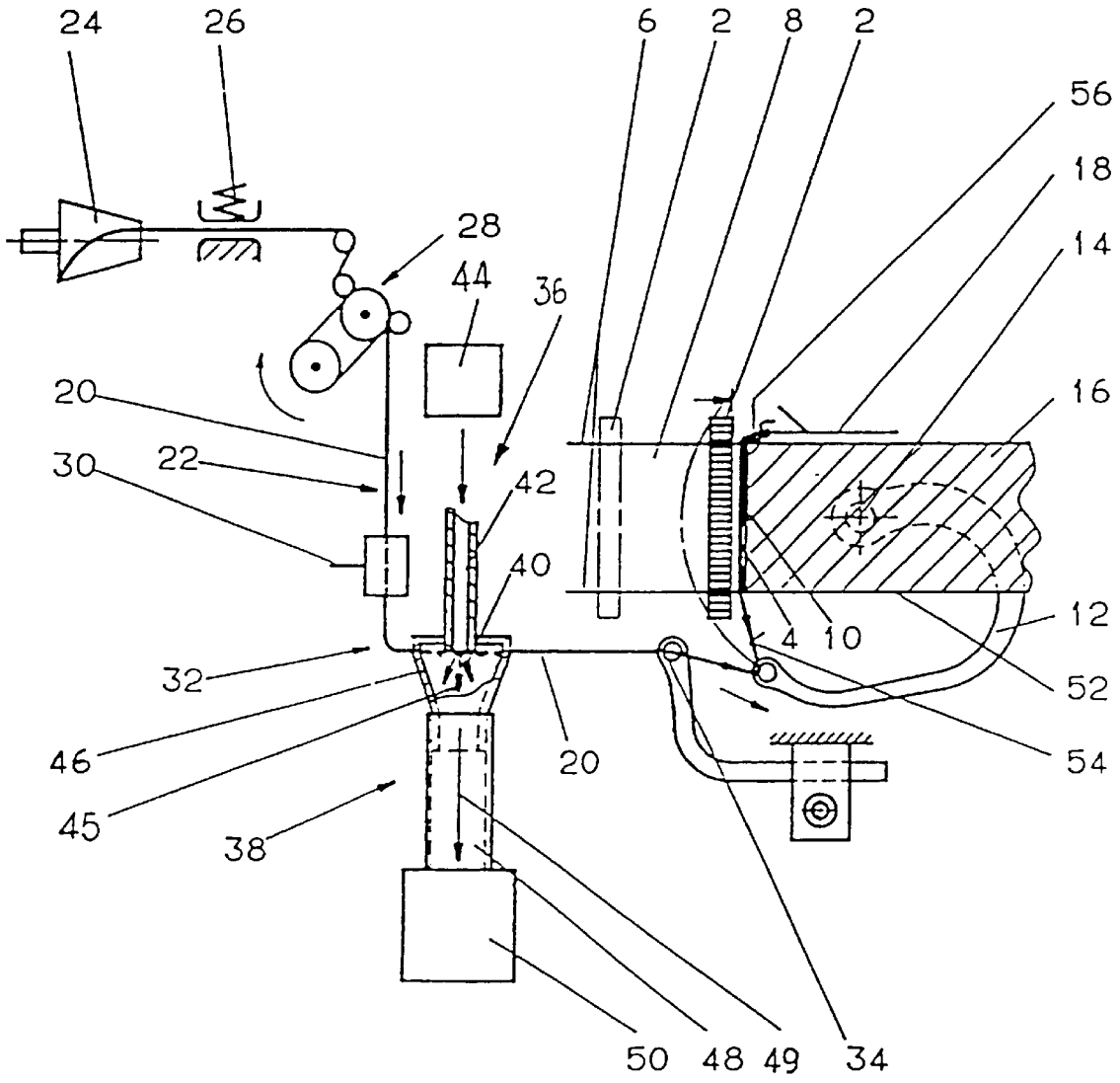
FIG. 1, the weft supply device of a ribbon loom represented in the form of a block diagram, the weft insertion needle being in the withdrawn position.
Figure 2:
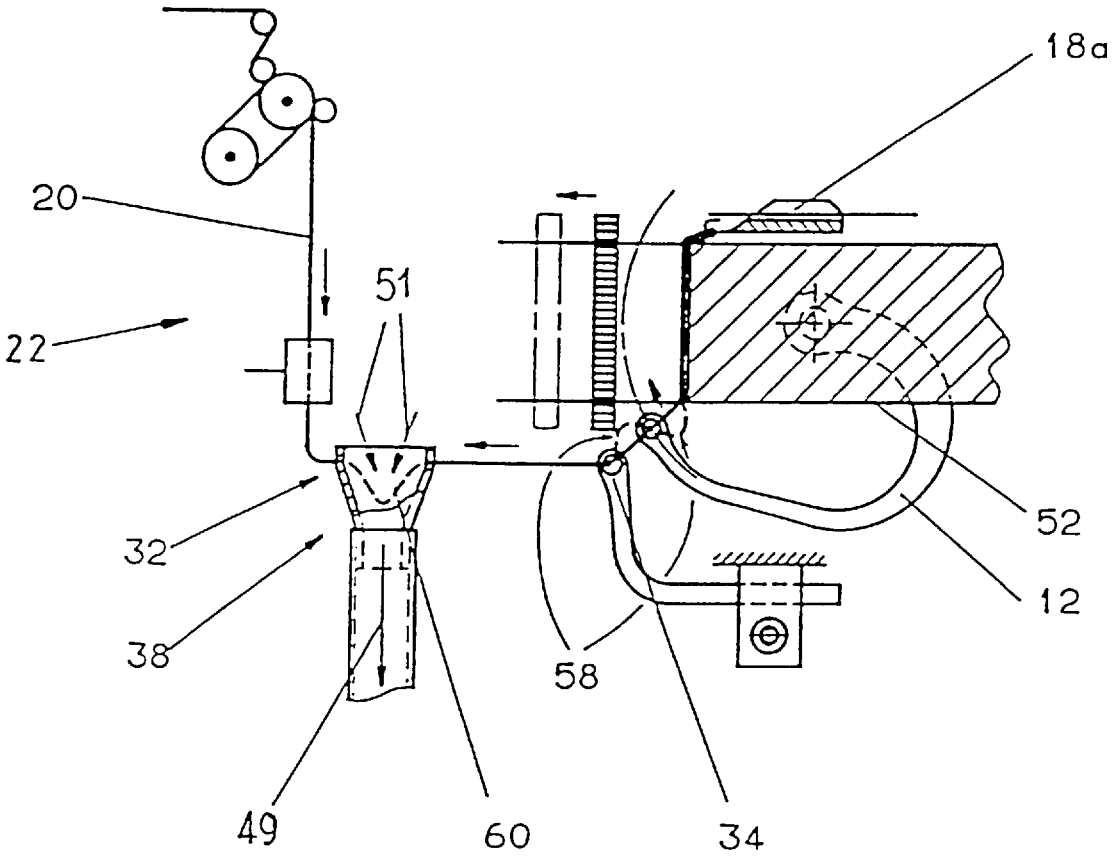
FIG. 2, the weft supply device of FIG. 1 with a modified weaving needle and with incipient insertion of the weft.
Figure 3:
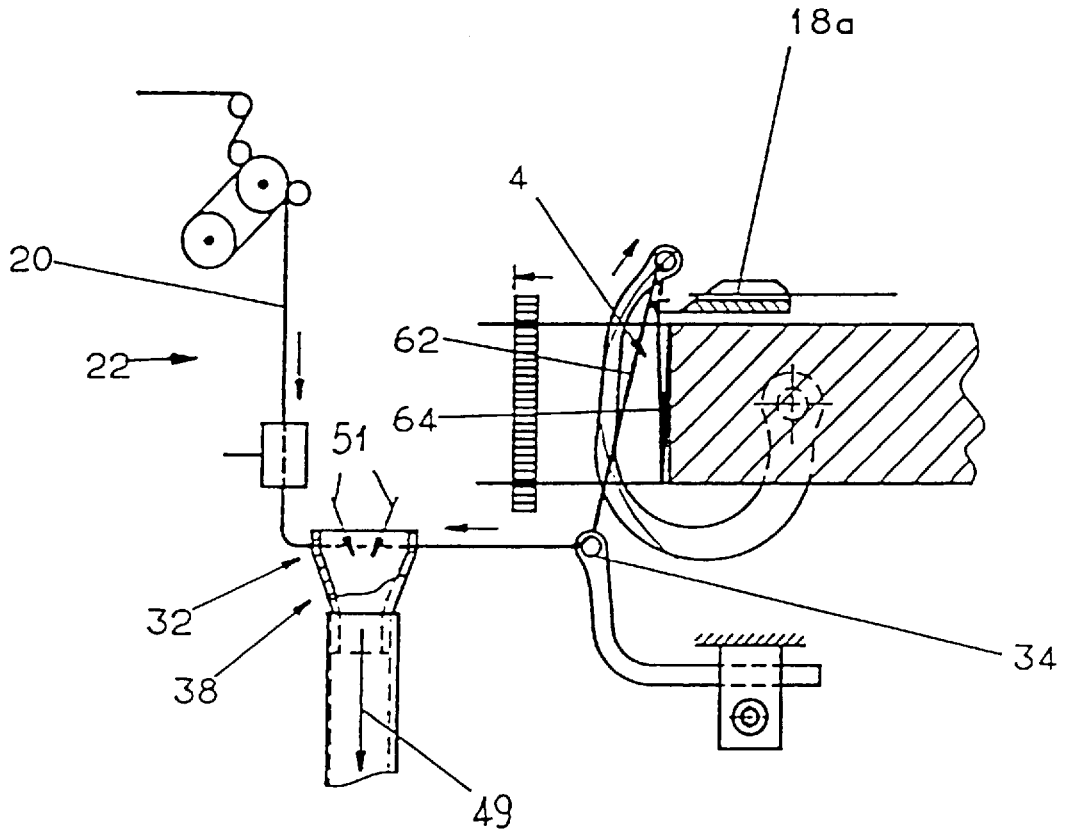
FIG. 3, the weft supply device of FIG. 2 with the weft loop inserted.

FIGS. 1 to 3 show essential components of a ribbon loom, represented similar to a block diagram, in various operating conditions of the weft insertion needle. The ribbon loom has a weaving reed 2, which abuts a weft loop 4, which has been inserted into a shed formed by warps 6, against a material edge 10. For insertion of the weft loop 4, a weft insertion needle 12 is used, which is designed sickle shaped and is pivotable back and forth around an axis 14. A weaving needle 18 is positioned on the insertion side of the fabric web 16 for binding off of the weft loop 4. The insertion side of the fabric web 16, which is the manufactured ribbon, is the side on which the weft insertion needle 12 is positioned. In FIG. 1, the weaving needle is designed as a latch needle, and FIGS. 2 and 3 as slide needle 18*a*, which, based on FIGS. 8 to 11, is explained, in greater detail hereinafter.

Weft insertion needle 12 is supplied with a weft 20 by means of a supply device 22. It (22) has, when viewed in the direction of movement of the weft, the following components. As weft source 24, for example, a weft bobbin is used, from which weft 20, for example across an adjustable thread braking device 26, reaches a conveying device 28, which continuously conveys weft 20 at an adjustable speed. From there, via a preferably optically-designed weft protector 30, the weft reaches a pneumatically operating compensating device 32 and moreover, via an adjustable-position guide eye 34, weft insertion needle 12. Instead of the connection ahead of it, as shown in solid lines, the weft protector of compensating device 32 can instead be connected after the latter as shown in dashed lines. The pneumatically operating compensating device 32 has a blowing device 36 and/or suction device 38, which cooperates or which cooperate with the weft. The blowing device 36 comprises a blowing nozzle 40 which is connected, via a line 42, to a blower device 44, which generates compressed air 45. In analogy, suction device 38 is equipped with a suction nozzle 46, which is connected, via a line 48, to the suction side of a blower device 50 and generates suction air 49. In FIG. 1, the compensating device 32 is illustrated both with a blowing device 36 and with a suction device 38, suction air 49 being drawn-in ambient air 51. In FIGS. 2 and 3, only a suction device 38 is used, which is described in greater detail based on FIGS. 6 and 7.

The pneumatic compensating device 32 serves, on the one hand, for receiving a weft reserve, which depends on the intermittent weft takeoff upon insertion of the weft loop into the shed. On the other hand, the compensating device also serves for providing the weft with the tensile stress required for insertion of the weft loop into the shed.

In FIG. 1, the weft insertion needle is in the withdrawn position, in which the weft forms, between material edge 52 and guide eye 34, a retraction loop 54 for taking up weaving loop 56. At this stage, weft loop 4, inserted into the shed 8, is also butted against material edge 10. As FIG. 2 indicates, simultaneous with the pivoting back of weaving reed 2, begins also the insertion motion of the weft insertion needle 12. In FIG. 2, the position of the weft insertion needle is shown as it passes the guide eye 34 before insertion of the weft loop, the components of the supply device and, in particular, the compensating device 32 being adjusted in such way that, between the guide eye 34 and the material edge 52, the weft runs in a straight line, the excess length of the weft being received by the compensating device 32. Shown in dashed lines is the way. the weft path 58 would run if there were no adequate weft tension. The conveying device 28 is adjusted in such way that, at this stage, in compensating device 32, a weft reserve 60 has formed, which (reserve) is used up during insertion of the weft loop into the shed shown in FIG. 3. In the phase shown in FIG. 3, the weft insertion needle has inserted weft loop 4 into shed 8 in such a way that, during binding off of the weft loop, the weft for mesh formation is inserted into weaving needle 18*a*. Here again, the components, in particular the compensating device 32 of the supply device 22, are adjusted in such way that the weft loop lies in the shed 8 with extended legs 62, 64. During withdrawal of weft insertion needle 12 from shed 8, no weft 20 is required. The constantly operating conveying device 28, in contrast, continuously delivers weft, which is taken up by the compensating device as weft reserve 60 and held ready for the next weft cycle.

The individual components of the supply device 32 can be coordinated with each other by means of a suitable control device, not illustrated in detail, which may comprise a computer.

FIG. 4 shows a compensating device 32 designed as a blowing device 36, in which (32) blowing nozzle 40 acts on the weft 20, which is guided between two guides 66, 68, which can be arranged in a shallow chamber similarly to the chamber 82 shown in FIGS. 6 and 7.

FIG. 5 shows a further compensating device 32*a*, in which weft 20 is guided in a channel section 70, into which a blowing nozzle 72 opens and, indeed, does so at such an angle, that the blown air stream 74 is directed opposite to running direction 76 of the weft. The weft can then form a weft reserve 78 between the end of the channel section 70 and a guide 80.

FIGS. 6 and 7 show the compensating device 32 used in FIGS. 1 to 3, which is designed as a suction device 38. For this purpose, the suction device contains a shallow chamber 82, which has, on one narrow side 84, a weft supply 86 and on the other narrow side a weft discharge 88. The width B of the chamber is preferably dimensioned in such way that it is equal to or smaller than 50 times thickness D of weft 20. Length C of the chamber is greater than width B. Shallow chamber 82 of suction nozzle 46 turns into line 48. Chamber 82 is equipped with a weft protector 90 on its open side, which (90), by means of a monitoring beam 91 of a diode, pointing in the direction of flow 92 of the suction air flow, in order to monitor weft 20, or a weft reserve 60. Suction is effected by means of a known suction pump, not illustrated.

Figure 8:
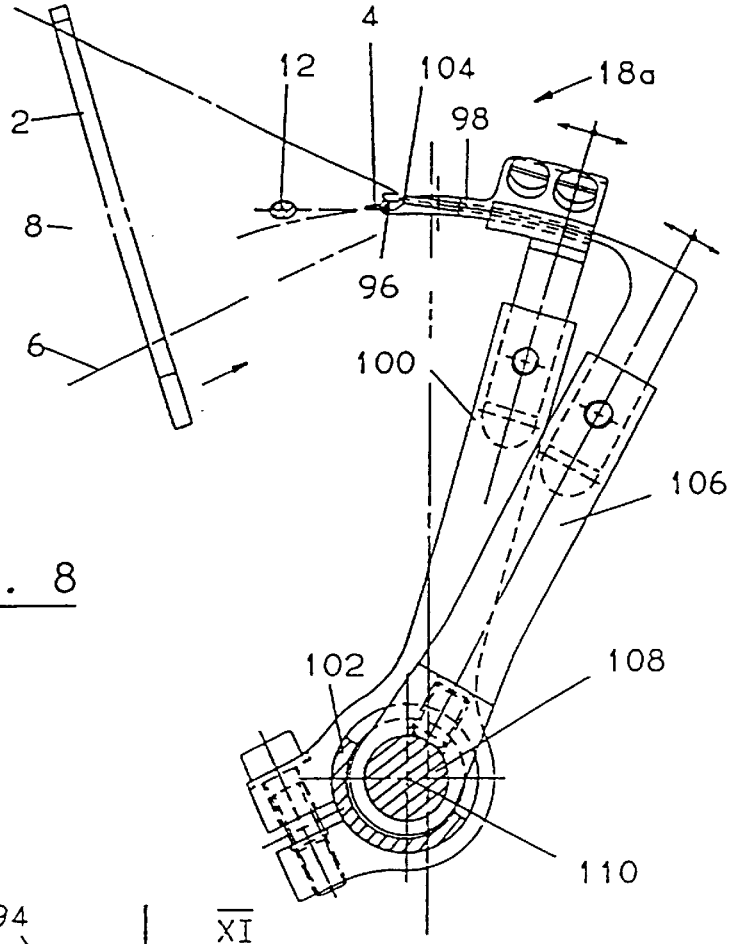
FIG. 8, a slide needle device in a lateral view.
Figure 9:
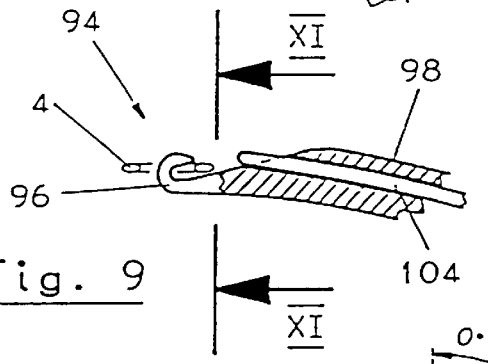
FIG. 9, the head of the slide needle in an open condition, in a section along the slide and at a larger scale.
Figure 10:
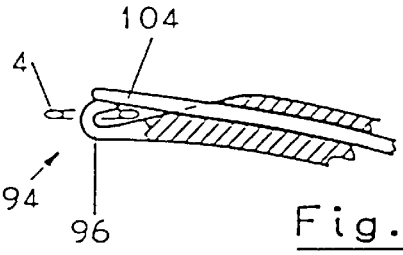
FIG. 10, the head of the slide needle in accordance with FIG. 9 in its closed condition, and FIG. 11, the head of the slide needle of FIG. 9 in the Section XI—XI of FIG. 9.
Figure 11:
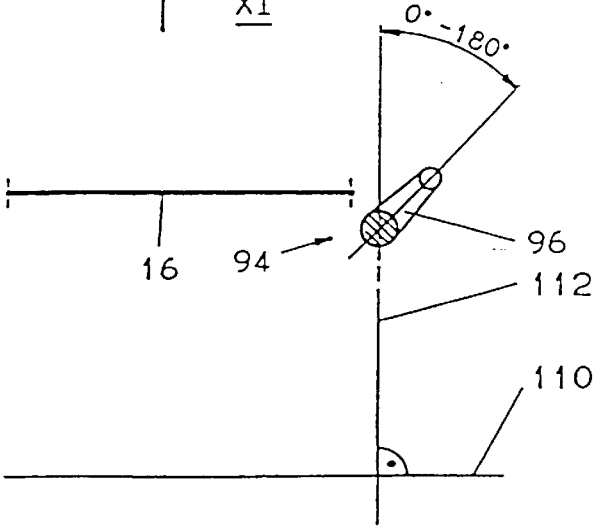

FIGS. 8 to 11 show a slide needle device whose basic structure is known, for example from CH-PS 644 163. Slide needle 18*a* consists of a needle head 94 having a hook 96, which is arranged on a hollow needle shank 98. The latter is attached to a hook lever 100, which is connected to a hollow shaft 102, which executes the required pivoting motion. The slide needle comprises slide 104 guided by hollow shank 98, which (104) is attached to a slide lever 106 which, in turn, is arranged on a shaft 108 that lies in hollow shaft 102 and provides the back-and-forth motion of slide 104. Hollow shaft 102 of hook 96 and shaft 108 of slide 104 are thus arranged coaxially about a common axis 110. FIG. 8 also shows the assignment of slide needle 18*a*, to shed 8, which is formed by the warp yarns 6, and to weft insertion needle 12 as well as to weaving reed 2. In FIG. 9, needle head 94 is shown in the open position suitable for accepting a weft loop 4. For weaving purposes, slide needle 18*a* is closed, as evident from FIG. 10.

Advantageously, hook 96 of slide needle 18*a* on the side facing away from the weft insertion needle or from the material web 16 is inclined at an angle of 0° to 180° to the plane of motion 112 of the slide needle 18*a*.

List of reference numbers

2 Weaving reed
4 Weft loop
6 Warp
8 Shed
10 Material edge
12 Weft insertion needle
14 Axis
16 Material web
18 Weaving needle
18*a* Slide needle
20 Weft
22 Supply device
24 Weft source
26 Weft braking device
28 Conveying device
30 Weft protector
32 Compensating device
32*a* Compensating device
34 Guide eye
36 Blowing device
38 Suction device
40 Blowing nozzle
42 Line
44 Blower device
45 Compressed air
46 Suction nozzle
48 Line
49 Suction air
50 Blower device
51 Ambient air
52 Material edge
54 Retraction loop
56 Weaving loop
58 Weft path
60 Weft reserve
62 Leg
64 Leg
66 Guide
68 Guide
70 Channel section
72 Blowing nozzle
74 Blown air stream
76 Running direction

78 Weft reserve
80 Guide
82 Chamber
84 Narrow side
86 Weft supply
88 Weft discharge
90 Weft protector
91 Monitoring beam
92 Direction of flow, suction air
94 Needle head
96 Hook
98 Needle shank
100 Hook lever
102 Hollow shaft
104 Slide
106 Slide lever
108 Shaft
110 Axis
112 Plane of motion

I claim:

1. A ribbon loom for making a material web in a thread running direction, the material web having a weft and a first warp and a second warp forming a shed, said ribbon loom comprising:

a weft insertion needle;

a weft supply device including a weft compensating device for tensioning the weft;

a weaving needle for binding off a loop formed by the weft and inserted into the shed;

structure operatively connecting said weft compensating device to a pneumatic source for pneumatically operating said compensating device for blowing and/or suction on the weft; and a separate weft guide eye positioned downstream from said weft compensating device and upstream from said weft insertion needle as viewed in the thread running direction.

2. A ribbon loom according to claim 1, including means for adjusting the position of the separate guide eye.

3. A ribbon loom according to claim 1, wherein the blowing device and/or suction device has a shallow rectangular chamber which comprises first and second narrow sides, said first narrow side having a weft supply and said second narrow side having a weft discharge.

4. A ribbon loom according to claim 3, wherein said weft has a thickness and said chamber has a width and a length, said width being equal to or smaller than 50 times the thickness of the weft and said length of said chamber is greater than said width.

5. A ribbon loom according to claim 3 including a weft protector and wherein said blowing device generates an air stream having a direction of flow, and wherein the weft in said chamber can be monitored for breakage or run-out by means of said weft protector, in the direction of flow of the air stream.

6. A ribbon loom according to claim 1, said weft having a running direction, including a blowing nozzle directing a blown air stream, wherein said compensating device has a channel section for the weft into which channel section said blowing nozzle opens at an acute angle in such a way that the blown air stream opposes the running direction of the weft.

7. A ribbon loom according to claim 1, including a weft braking device positioned upstream from said compensating device.

8. A ribbon loom according to claim 1, including an optically designed weft protector positioned upstream or downstream from said compensating device.

9. A ribbon loom according to claim 1, wherein said supply device has a weft source and a weft conveying device which are arranged upstream from said compensating device.

10. A ribbon loom according to claim 1, wherein said supply device includes means for adjusting the delivery speed of the weft whereby the weft runs in a straight line when the weft insertion needle is withdrawn as well as inserted.

11. A ribbon loom according to claim 10, said weft extension adjustment means including an adjustable-speed weft conveying device, wherein the extension of the weft is adjustable by adjusting the speed of said weft conveying device with the weft insertion needle either withdrawn or inserted.

12. A ribbon loom according to claim 1, including structure adjustably mounting said guide eye for adjusting the extension of the weft with the web insertion needle either withdrawn or inserted.

13. A ribbon loom according to claim 1, wherein said weaving needle is a slide needle.

14. A ribbon loom according to claim 13, wherein said weaving needle presents a hook part and a slide part which are both pivotable about the same axis.

15. A ribbon loom according to claim 13, wherein a material web is woven from said weft and said warps and presents a side oriented away from the weft insertion needle, and wherein the slide needle moves through a plane of motion and presents a hook positioned on that side of said plane facing away from the material web, said hook being inclined at an angle of 0° to 180° to the plane of motion of the slide needle.

* * * * *